United States Patent [19]

Favors

[11] Patent Number: 4,784,233

[45] Date of Patent: Nov. 15, 1988

[54] SKI BOARD

[76] Inventor: Alexander L. Favors, 70 Creek Rd., Chalfont, Pa. 18914

[21] Appl. No.: 78,169

[22] Filed: Jul. 27, 1987

[51] Int. Cl.[4] ..... A63C 17/18

[52] U.S. Cl. ..... 280/12 H; 280/16; 280/28

[58] Field of Search ..... 280/11.12, 601, 607, 280/11.14, 11.15, 11.18, 11.3, 12 H, 12 K, 16, 15, 28

[56] References Cited

U.S. PATENT DOCUMENTS

| | | | |
|---|---|---|---|
| 3,580,592 | 5/1971 | Schrecengost | 280/651 |
| 4,221,394 | 9/1980 | Campbell | 280/12 H |
| 4,305,603 | 12/1981 | Muller et al. | 280/12 H |

FOREIGN PATENT DOCUMENTS

| | | | |
|---|---|---|---|
| 762342 | 7/1967 | Canada | 280/12 K |

*Primary Examiner*—John J. Love
*Assistant Examiner*—Richard Camby
*Attorney, Agent, or Firm*—Leon Gilden

[57] ABSTRACT

A wheeled skate board is modified for skiing purposes by replacing the two sets of wheels with two pivotally attached skis.

7 Claims, 5 Drawing Sheets

FIG 7
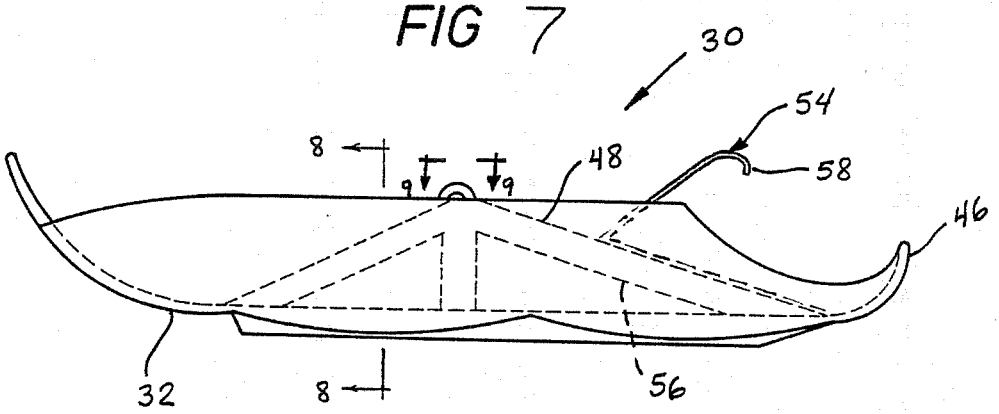
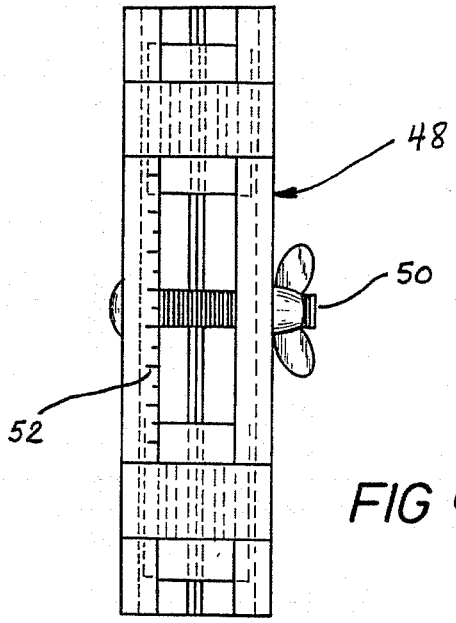
FIG 9

SKI BOARD

BACKGROUND OF THE INVENTION

1. Field of the Invention

The present invention relates to skiing equipment, and more particularly pertains to a new and improved skiing device which operates in a manner similar to a conventional skate board.

2. Description of the Prior Art

In recent years, skate boards have become increasingly popular—both as an item of entertainment and exercise. Conventional skate boards typically consist of a board having two sets of roller skate wheels mounted at opposite ends thereof, and a user must balance himself upon the board while providing a propelling force for movement. However, skate boards are seasonal devices inasmuch as they cannot be utilized in snow and further, their use is limited to hard smooth surfaces since they are propelled and supported by wheels. Accordingly, it would appear that there exists an interest for skate boards which could be utilized in snow or on water, and in this respect, the present invention addresses this interest.

SUMMARY OF THE INVENTION

In view of the foregoing disadvantages inherent in the known types of conventional skate boards now present in the prior art, the present invention provides an improved skate board construction wherein the same can be modified so as to permit the use of small pivotally attached skis in substitution for the wheels normally attached thereto, thereby to permit a usage of the skate boards on water or snow. As such, the general purpose of the present invention, which will be described subsequently in greater detail, is to provide a new and improved modified skate board construction which has all the advantages of the prior art conventional skate boards and none of the disadvantages.

To attain this, the present invention comprises a conventional skate board wherein the two sets of roller skate wheels may be removed and replaced by pivotally attached skis. As such, the skate board is supported by a pair skis as opposed to wheels which thus permits a usage of the skate board over snow or water.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved skate board construction which has all the advantages of the prior art skate board constructions and none of the disadvantages.

It is another object of the present invention to provide a new and improved skate board construction which may be easily and efficiently manufactured and marketed.

It is a further object of the present invention to provide a new and improved skate board construction which is of a durable and reliable construction.

An even further object of the present invention is to provide a new and improved skate board construction which is susceptible of a low cost of manufacture with regard to both materials and labor, and which accordingly is then susceptible of low prices of sale to the consuming public, thereby making such skate board constructions economically available to the buying public.

Still yet another object of the present invention is to provide a new and improved skate board construction which provides in the apparatuses and methods of the prior art some of the advantages thereof, while simultaneously overcoming some of the disadvantages normally associated therewith.

Still another object of the present invention is to provide a new and improved skate board construction which utilizes sets of skis that may be interchanged with the wheels forming a part of the skate board.

Yet another object of the present invention is to provide a new and improved skate board construction wherein such skate board can be utilized on snow or water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a side elevation view of a modified embodiment of the invention.

FIG. 9 is a top plan view of the invention taken along the line 9—9 in FIG. 7.

DESCRIPTION OF THE PREFERRED EMBODIMENT

Figure 1:
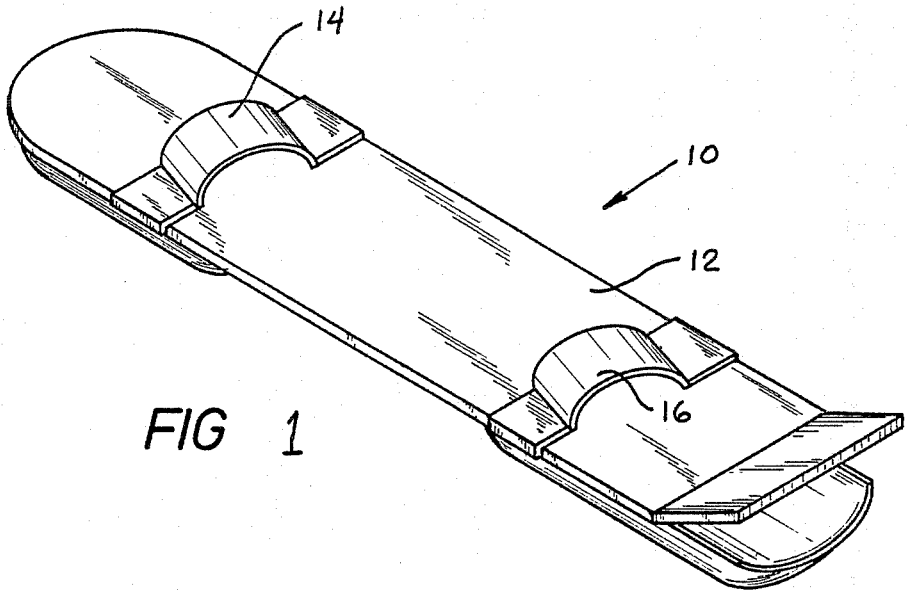
FIG. 1 is a perspective view of the ski board comprising the present invention.

With reference now to the drawings, and in particular to FIGS. 1–4 thereof, a first embodiment of a new and improved portable ski board embodying the principles and concepts of the present invention and generally designated by the reference numeral 10 will be described.

More specifically, it will be noted that the ski board 10 essentially comprises an elongated board member 12 having a pair of conventional foot straps 14, 16 attached to a top surface thereof. The foot straps 14, 16 may be optionally used or removed as desired and facilitate the retention of a user's feet in fixed engagement with the top surface of the board 12. In a preferred embodiment, the foot straps 14, 15 are angularly oriented with respect to the longitudinal axis of the board 12, thereby to permit a person to assume the conventional stance of a skate board user.

Figure 2:
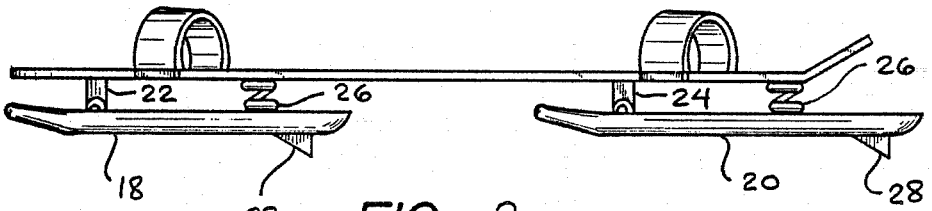
FIG. 2 is a side elevation view of the invention.
Figure 3:
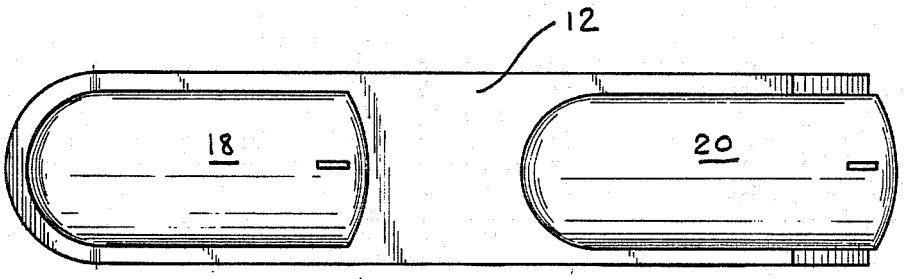
FIG. 3 is a bottom plan view of the invention.
Figure 4:
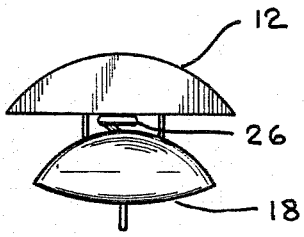
FIG. 4 is a front elevation view of the invention.

As best illustrated in FIGS. 2, 3 and 4, the conventional roller skate wheels normally associated with a skate board have been removed from the present invention, and a pair of small skis 18, 20 have been substituted therefor. The skis 18, 20 are respectively pivotally attached to a pair of downwardly extending support members 22, 24 which in turn are fixedly secured to a bottom surface of the board 12. As illustrated in FIG. 2, a coiled spring 26 could be inserted between a bottom surface of the board 12 and respective skis 18, 20 thereby to maintain each ski in a desired operable alignment with the board, as well as to allow pivotal movement of the ski during a use of the board over water or snow.

As also illustrated in the Figures, skis 18, 20 could be provided with downwardly extending, fixedly secured skegs 28. The skegs 28 would provide lateral stability to a user of the board 12. In this regard, the skegs 28 would be most desirable in those situations where the ski board 10 is used to propel a user across a body of water. If desired, the skeg 28 could be removably attached to a bottom surface of skis 18, 20, thereby to permit an alternative use of the ski board 10 on a surface of snow.

Figure 5:
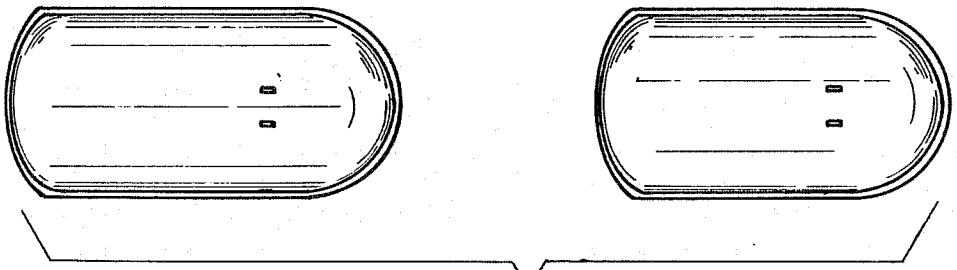
FIG. 5 is an illustration of a wide set of skis which may be utilized in combination with the invention.
Figure 6:
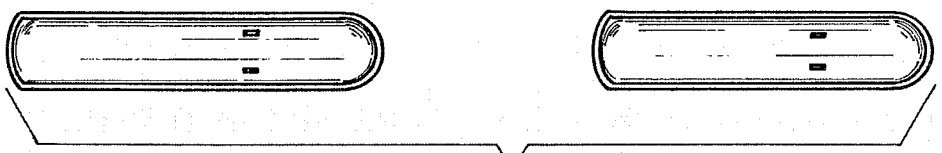
FIG. 6 is an illustration of a narrow set of skis which can be utilized in combination with the invention.

FIGS. 5 and 6 have been provided of general interest to illustrate various designs of skis 18, 20 which could be used in combination with the present invention. More particularly, FIG. 5 illustrates the skis 18, 20 in a wide design, such as might be desirably used by a beginner. By the same token, FIG. 6 illustrates the skis 18, 20 in a narrow design such as might be utilized by a more experienced person. As such, the modifications illustrated in FIGS. 5 and 6 are illustrative of many variations of the present concept, and all such variations are within the intent and purview of the present invention.

Figure 8:
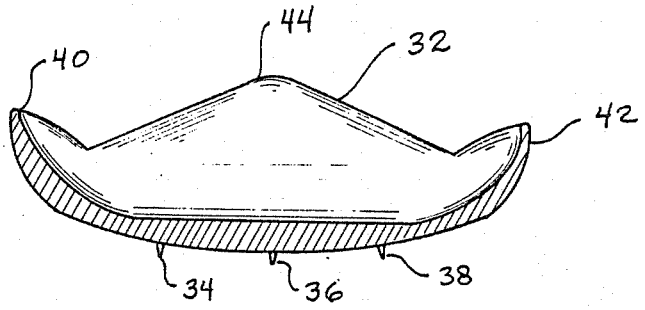
FIG. 8 is a cross-sectional view of the invention taken along the line 8—8 in FIG. 7.

FIGS. 7, 8 and 9 illustrate a modified embodiment of the invention which is generally designated by the reference numeral 30. In this regard, the embodiment 30 essentially comprises a specific design of ski 32 which may be attached to the bottom of a skate board 12. As shown, the ski 32 may include a plurality of longitudinally aligned skegs 34, 36, 38. Further, FIGS. 7 and 8 clearly illustrate the concave design of the ski 32 whereby the same is provided with upwardly extending, curvilinearly-shaped integral sides 40, 42, and upwardly extending integral forward section 44, and a similar upwardly extending rear section 46. These upwardly extending integrally attached sides 40, 42, 44, 46 serve to prevent an accumulation of snow around an adjustable axial mount assembly 48. The adjustable axle mount assembly 48. The adjustable axle mount assembly 48 includes a wind nut arrangement 50 for effecting an attachment of the ski 32 to the normally present wheel axle associated with the skate board 12. Additionally, a calibrating scale 52 may be provided on the adjustable axle mount assembly 48 so as to effectively align the ski 32 during its operable connection to a skate board 12.

FIG. 7 further illustrates an upwardly extending spring steel member 54 which is fixedly secured to a support strut 56 forming a part of the adjustable axle mount assembly 48. The spring member 54 serves to prevent the ski 32 from coming up into an abutting relationship with a bottom portion of a skate board 12 in a manner analogous to that of the aforementioned springs 26. As illustrated, spring member 54 includes a curvilinearly shaped top section 58 which is directly abuttable with a bottom section of the skate board 12.

As to the manner of usage and operation of the present invention, the same should be apparent from the above description. Accordingly, no further description of the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved skiing apparatus comprising:
elongated support means for supporting a user in the standing position thereon; and
a plurality of ski means attached to a bottom portion of said elongated support means and spaced longitudinally from each other;
each of said ski means including a downwardly extending support integrally attached to said elongate support means at an upper end of said supports and pivotally attached to each of said ski means at lower ends of said supports and each said ski means further comprising a unitary coil spring rearwardly positioned and independently mounted of said supports between said elongated support means and each of said ski means, said unitary spring serving to retain said ski means in a desired position relative to said elongate support means.

2. The new and improved skiing apparatus as described in claim 1, and further including foot straps attached to a top surface of said elongated support means.

3. The new and improved skiing apparatus as described in claim 2, wherein said foot straps are angularly positioned along a top surface of said elongated support means, thereby to provide an optimum stance position for said user.

4. The new and improved skiing apparatus as described in claim 1, and further including skeg means removably attached to a bottom portion of said ski means.

5. The new and improved skiing apparatus as described in claim 1, wherein said ski means includes a curved wall portion extending around an entire peripheral edge of said ski means.

6. The new and improved skiing apparatus as described in claim 5, wherein said curved wall portion defines an interior concave surface on said ski means.

7. The new and improved skiing apparatus as described in claim 1, wherein said fixed supports include an adjustable axle mount assembly.

* * * * *